United States Patent [19]

Yamaguchi et al.

[11] Patent Number: 4,742,613

[45] Date of Patent: May 10, 1988

[54] CABLE CORE SELF-ALIGNING APPARATUS

[75] Inventors: Shizuka Yamaguchi; Yoshihiko Ueno; Seiji Ohmizu; Isamu Kinoshita, all of Ichihara, Japan

[73] Assignee: The Furukawa Electric Co., Ltd., Tokyo, Japan

[21] Appl. No.: 36,746

[22] Filed: Apr. 10, 1987

[30] Foreign Application Priority Data

| | | | |
|---|---|---|---|
| Apr. 11, 1986 | [JP] | Japan | 61-82288 |
| Apr. 15, 1986 | [JP] | Japan | 61-84951 |
| May 20, 1986 | [JP] | Japan | 61-115881 |
| Jun. 25, 1986 | [JP] | Japan | 61-149911 |
| Jul. 28, 1986 | [JP] | Japan | 61-115436[U] |
| Jul. 30, 1986 | [JP] | Japan | 61-177682 |
| Jul. 30, 1986 | [JP] | Japan | 61-115953[U] |

[51] Int. Cl.[4] ..... H01R 43/04

[52] U.S. Cl. ..... 29/759; 29/593; 29/705; 29/714; 29/749

[58] Field of Search ..... 29/753, 754, 759, 705, 29/714, 715, 716, 749, 593

[56] References Cited

U.S. PATENT DOCUMENTS

| | | | |
|---|---|---|---|
| 4,557,046 | 12/1985 | Suzuki et al. | 29/749 |
| 4,624,037 | 11/1986 | Anne et al. | 29/593 X |

FOREIGN PATENT DOCUMENTS

| | | |
|---|---|---|
| 59-71275 | 4/1984 | Japan . |
| 59-180684 | 12/1984 | Japan . |

*Primary Examiner*—Carl E. Hall

*Attorney, Agent, or Firm*—Foley & Lardner, Schwartz, Jeffery, Schwaab, Mack, Blumenthal & Evans

[57] ABSTRACT

A cable core self-aligning apparatus comprises core feeding means for holding a plurality of cores, drawn out of an end of a cable, in a line and sequentially feeding the cores; rotational conveyor means having a conveying rotor for holding and rotationally conveying each of the cores to a core extracting position; and core identifying means for identifying the number of each core while that core is being conveyed to the core extracting position by the rotational conveyor means. The cable core self-aligning apparatus also includes a core holder having a plurality of core-positioning sections; core-holder positioning means for setting that of the core-positioning sections which is associated with the number of the core identified by the core identifying means, at the core extracting position when the core holder receives the identified core; and core handling means for holding and inserting the core reaching the core extracting position by the help of the conveying rotor, into the core-positioning section set by the core-holder positioning means.

15 Claims, 8 Drawing Sheets

CABLE CORE SELF-ALIGNING APPARATUS

BACKGROUND OF THE INVENTION

1. Field of the Invention:

This invention relates to a cable core self-aligning apparatus which aligns a plurality of cable cores, pulled out of a cable's end, in a predetermined order.

2. Description of the Prior Art:

In order to provide wiring inside a device and/or wiring between devices in a computer-based office automation, it is typical that a multicore cable, having a circular cross section, is used as an input/output (I/O) cable, and is attached with a flat connector at its end to be coupled to an associated device.

To attach a flat connector to a cable, it is necessary that the cable cores drawn from the cable's end be aligned in a predetermined order. Specifically, this alignment is done as follows. First, one of the drawn-out cable cores is arbitrarily selected, and its core number is identified, so that the core is aligned at a position corresponding to the identified core number. Then, the next core is selected, and after its core number is identified, it is similarly aligned at a position corresponding to the core number. This is repeated until the last core is aligned at its proper position.

However, this method of identifying and aligning cores one by one is not efficient, but is time-consuming, particularly when the involved cable has a large number of cores.

The inventions disclosed in Japanese Patent Disclosure No. 59-71275 and 59-180684 have been proposed to solve this problem.

The device disclosed in Japanese Patent Disclosure No. 59-71275 comprises:

(A) means for identifying a core number according to a change in electrostatic capacitance of a cable core that is caused by an operator's fingers touching the core;

(B) means for fixing a pressure-welding connector, set on an operation table, to a predetermined state, and positioning a pressure-welding contact of the connector, which corresponds to an identification signal, in such a manner that the contact faces its associated pressure-welding section; and (C) means for holding the core, cutting the core to a proper length, and inserting the cut end of the core into the pressure-welding contact for pressure-welding.

In this prior art, the insertion of the core end into the pressure-welding section is carried out by an operator.

The device disclosed in Japanese Patent Disclosure No. 59-180684 comprises:

(a) means for aligning and supporting a plurality of cores on a plane;

(b) means for detecting an end of a core using a sensor, providing a separator between the detected core and an adjacent core for their separation, and feeding the separated core to a position where a core conveying means receives the core;

(c) core conveying means for conveying the core from the separated position to an aligning position in a circular movement;

(d) means for receiving the core conveyed by the core conveying means, and cutting the coating of the core to provide electric connection between the core and a core number identifying mechanism, thereby identifying the number of the core;

(e) means for positioning a core-aligning mechanism based on the identified core number, the core-aligning mechanism returning to a reference position for alignment of each core to be ready for the next core;

(f) a core aligning plate having grooves for fixing the respective cores and fixed to the base of the main body of a core aligning device; and (g) means for controlling temporary stopping of the core conveyance, position adjustment of the core and insertion of the core into an associated groove of the core aligning plate, and fixing the core on the core aligning plate after an unnecessary portion of the core is cut out.

3. Disadvantages of the Prior Art:

The invention disclosed in Japanese Patent Disclosure No. 59-71275 requires manual aligning of cores and does not therefore provide a real self-aligning system. Further, this prior art has a lower productivity such that it is only capable of aligning about seven cores per hour.

The invention disclosed in Japanese Patent Disclosure No. 59-180684 provides a more self-aligning system than the invenion as claimed in Japanese Patent Disclosure No. 59-71275 and therefore has a higher productivity. However, the core-aligning device of Japanese Patent Disclosure No. 59-180684 is complicated and requires its core aligning mechanism returning to a reference position for alignment of each core, thus causing some unnecessary aligning movement.

SUMMARY OF THE INVENTION

With the above situation in mind, it is an object of this invention to provide a cable core self-aligning apparatus, which is capable of shortening the aligning time and efficiently aligning cores without unnecessary aligning procedures.

To achieve the above object, the cable core self-aligning apparatus of this invention comprises:

core feeding means for holding a plurality of cores, drawn out of an end of a cable, in a line and sequentially feeding out the cores;

rotational conveyor means having a conveying rotor for holding and rotationally conveying each of the cores, sequentially fed by the core feeding mechanism, to a core extracting position;

core identifying means for identifying the number of each core conveyed by the rotational conveyor means while that core is being conveyed to the core extracting position;

a core holder having a plurality of core-positioning sections;

core-holder positioning means for setting that of the core-positioning sections which is associated with the number of the core identified by the core identifying means, at the core extracting position when the core holder receives the identified core; and core handling means for holding and inserting the core reaching the core extracting position by the help of the conveying rotor, into the core-positioning section set by the core-holder positioning means.

According to the apparatus of this invention, the conveying rotor of the rotational conveyor means sequentially conveys the cores, which are randomly fed in a line from the core feeding means, to the core extracting position one by one, and detecting means of the core identifying means identifies each core being conveyed. Accordingly, it is possible to simultaneously align a plurality of cores, thus shortening the time required for the overall core aligning.

DESCRIPTION OF THE PREFERRED EMBODIMENTS

Figure 1:
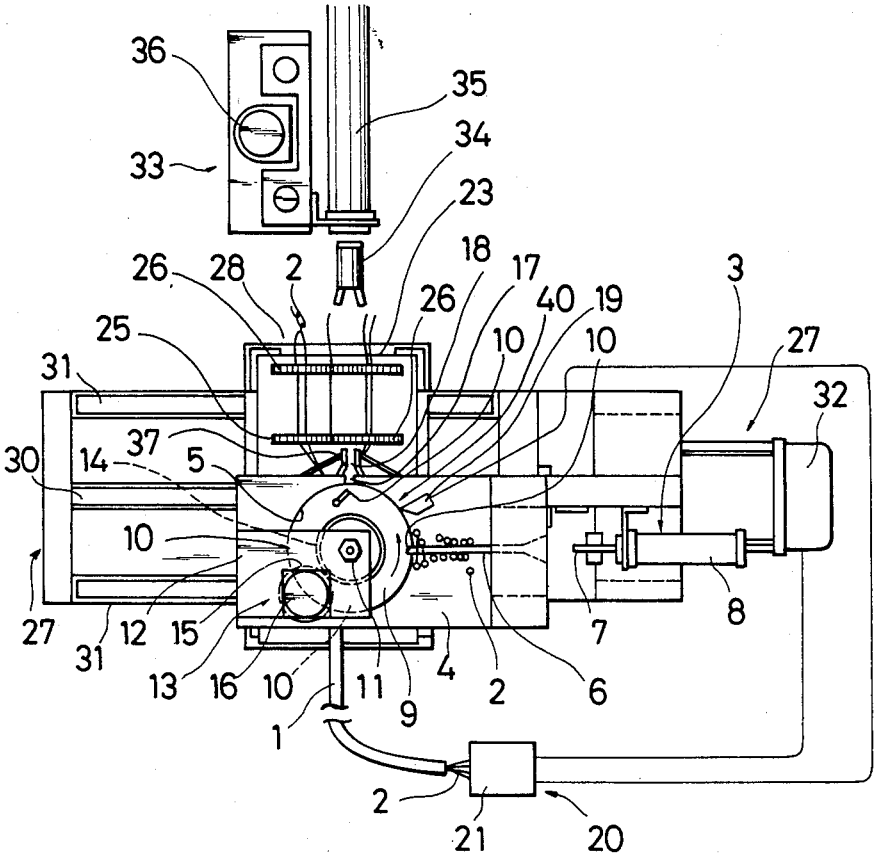
FIGS. 1 to 3 are a plan view, a partly longitudinal cross-sectional front view and a left-side view of a cable core self-aligning apparatus, respectively, according to one embodiment of this invention.
Figure 2:
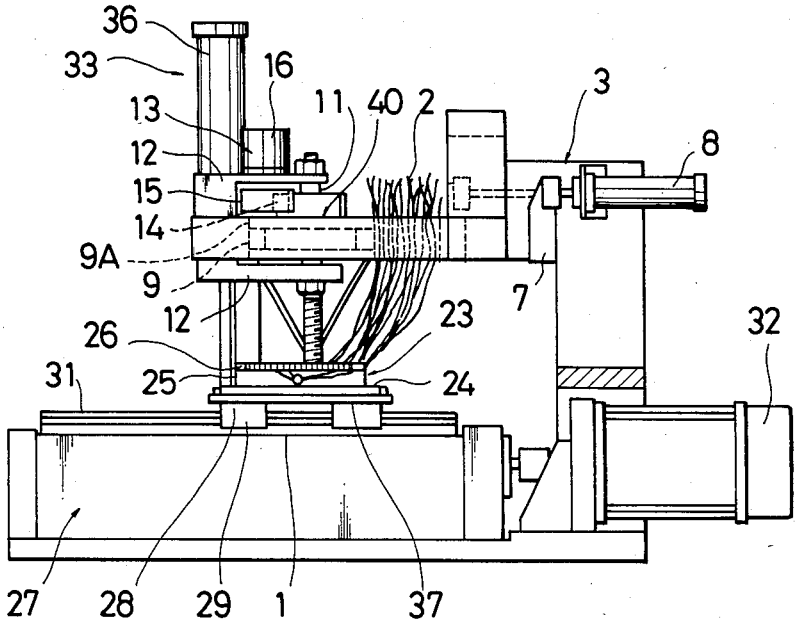

An embodiment of this invention will now be described with reference to FIGS. 1 to 5.

A plurality of cores 2 are drawn from an end of a cable 1. A core feeder 3 is capable of randomly feeding those cores 2 in a line. Specifically, the core feeder 3 randomly inserts each core 2 in a line into a core-guide slit 6, which communicates with a rotor-mounting hole 5 of a support 4, and pushes the line of the cores by operating a core urging plate 7 through a cylinder 8. Consequently, the lined cores 2 are sequentially fed toward the rotor-mounting hole 5.

A disk-shaped conveying rotor 9, which mainly constitutes a rotational conveyor 40, is rotatably mounted in the rotor-mounting hole 5 of the support 4. The conveying rotor 9 has a plurality of core holding grooves 10 on its periphery, which are parallel to the rotational axis of the rotor. Core holding grooves 10 are separated 90 degrees from one another in the drawings, and their widths and depths are so determined that each groove can receive only a single core 2. Every time each core holding groove 10 of the conveying rotor 9 faces the guide slit 6 of the core feeder 3, that groove receives one of the lined cores 2.

A rotor shaft 11 provided at the center of the conveying rotor 9 is rotatably supported through a known bearing (not shown) by a bracket 12, which is supported by the upper and bottom surfaces of the support 4.

The conveying rotor 9 is coupled to a rotor driving means 13 of the rotational conveyor 40, which rotates the rotor intermittently. The rotor driving means 13 comprises a gear 14 fixed to the rotor shaft 11, a gear 15 to mesh with the gear 14, and a motor 16, which rotates the gear 15 and is supported by the bracket 12.

A core-extracting slit 17, which communicates with the rotor-mounting hole 5, is formed on a portion of the support 4 at the periphery of the conveying rotor 9. The core-extracting slit 17 is arranged 90 degrees from the outlet of the guide slit 6 in the rotational direction of the conveying rotor 9. In the illustrated embodiment, the center of the slit 17 is a core extracting position 18.

A core identifying mechanism 20, which has a detector 19 to electrically detect and identify the number of a core 2 passing in the core holding groove 10 between the outlet of the guide slit 6 and the core extracting position 18, is provided between these two points at the periphery of the conveying rotor 9.

A metal knife-shaped electrode fixed to support 4 is used as the detector 19, and is designed such that when the tip of the knife-shaped electrode is inserted into a tubular groove 9A formed on the periphery of the conveying rotor 9 and cuts in the insulative coating of the core 2 in the core holding groove 10, the knife-shaped electrode (detector 19) comes into electrical contact with the core 2.

The core identifying mechanism 20 has a core number identifying unit 21 to which each core 2 is coupled in a predetermined order at the other end (opposite to where the cores 2 are drawn) of the cable 1. The core number identifying unit 21 identifies the number of each core 2 in electrical contact with the detector 19 and produces data of identified number.

A core holder 23 arranged obliquely below the support 4 has a pair of comb-shaped core holding members 25 provided on a holder support 24. Each core holding member 25 has core positioning sections 26 of one of the core holding members 25 respectively face those of the other core holding member 25.

The core holder 23 causes a core-holder positioning mechanism 27 to position the proper core positioning section 26 at the core extracting position 18, based on the core number data from the core identifying mechanism 20.

The core-holder positioning mechanism 27 comprises a positioning table 28 on which the core holder 23 is monted, a screw 30 attached to a horse 29 below the table 28, a guide 31 for guiding the table 28 in a direction parallel to the screw 30, and a pulse motor 32, which rotates the screw 30 based on the core number data.

The core 2 carried to the core extracting position 18 via the conveying rotor 9 is extracted by a core handling mechanism 33 which is disposed to face the core at the core extracting position 18, and is inserted into the core positioning section 26 of the core holder 23, which is set at the position 18.

The core handling mechanism 33 comprises a core manipulating hand 34 positioned on the line of the core extracting position 18, a cylinder 35, which moves in the direction A or B to move the hand 34 closer to or away from the conveying rotor 9, and a cylinder 36, which moves in the direction C or D to vertically move the hand 34 together with the cylinder 35 on the line of the core extracting position 18.

A pair of core guiding mechanisms 37 are provided to directly guide the core 2 from the core extracting position 18 to the core positioning section 26 of the core holder 23 which is located directly below the core extracting position 18. The core guiding mechanism 37 are constituted by a frame formed by rods and pipes.

The operation of the aforementioned embodiment will now be explained.

Cores 2 arranged in the guide slit 6 in a random order are separated one at a time starting from the leading core and the separated core is placed in the associated core holding groove 10, every time the conveying rotor 9 rotates and the core holding groove 10 faces the outlet of the guide slit 6.

The core 2 received in the core holding groove 10 is carried to the core extracting position 18 as the conveying rotor 9 rotates. When the core 2 meets the kine-shaped electrode (detector 19) en route to the core extracting position 18, the knife-shaped electrode whose tip is inserted in the tubular groove 9A cuts in the insulative coating of the core 2 to come into an electrical contact with the core. Accordingly, the number of the core 2 is identified by the core number identifying unit 21 and the core number data (an electrical signal) is supplied to the pulse motor 32 of the core-holder positioning mechanism 27.

In response to the core number data, the pulse motor 32 moves the core holder 23 and the table 28 such that the core positioning section 26 corresponding to the core number data comes to the core extracting position 18. That is, the proper core positioning section 26 is set at the core extracting position 18.

Figure 3:
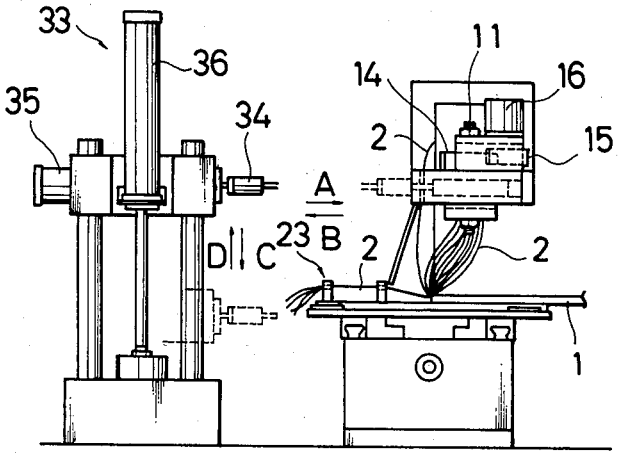
Figure 4:
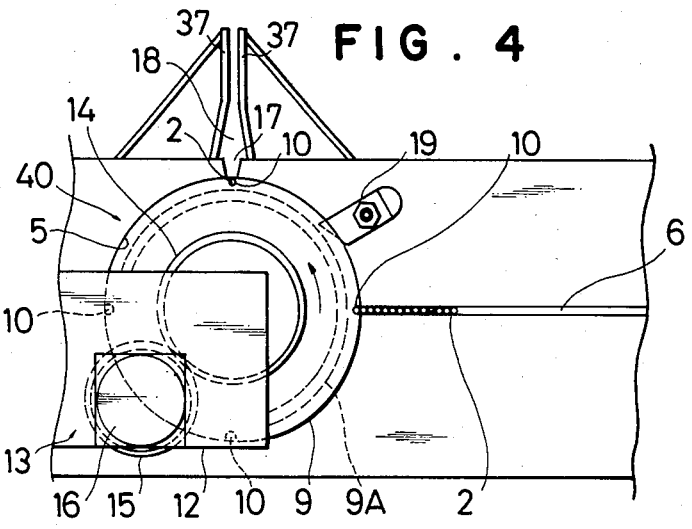
FIG. 4 is an enlarged plan view showing a conveying rotor used in this embodiment and around the rotor.
Figure 5:
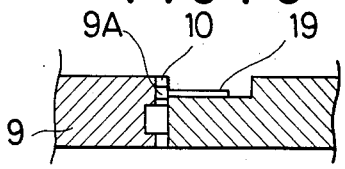
FIG. 5 is a longitudinal cross-sectional view of detecting means of this embodiment.

When the core 2 reaches the position 18 as the rotor 9 rotates, this is detected by a sensor (not shown) so that the cylinder 35 is moved forward in the direction A (FIG. 3). This moves the core manipulating hand 34 forward to grab the core 2 at the position 18.

After the core manipulating hand 34 grabs the core 2, the cylinder 35 retreats in the direction B (FIG. 3) and the cylinder 36 causes the hand 34 to descend in the direction C. Accordingly, the core 2 held by the hand 34 passes the core guiding mechanism 37 and is set in the corresponding core positioning section 26 waiting at the core extracting position 18.

When the aligning of the core 2 is completed, the core manipulating hand 34 releases the core it has been holding and goes up in the direction D (FIG. 3) to be ready for the aligning of the next core.

While the aforementioned operation is performed, the core 2 that has been inserted in the next core holding groove 10 by the rotation of the conveying rotor 9 is identified. Based on the data of the identified core number, the core holder 23 moves so that this core is set in the proper core positioning section 26 of the core holder 23, in the same manner as has been explained above.

In other words, before a single core 2 is extracted and is properly set in the corresponding core positioning section 26, the next core is identified, thus eliminating the unnecessary movement of each component and shortening the time required for the overall core aligning.

Another embodiment of this invention will now be explained.

Figure 6:
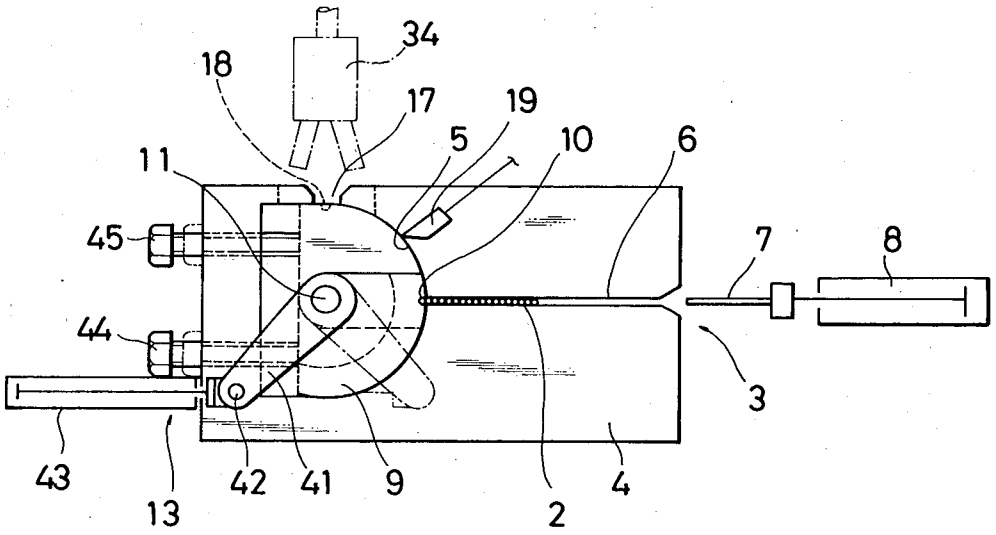
FIGS. 6 and 7 are a plan view and a longitudinal cross-sectional view of a modification of rotational conveyor means, respectively, of this invention.
Figure 7:
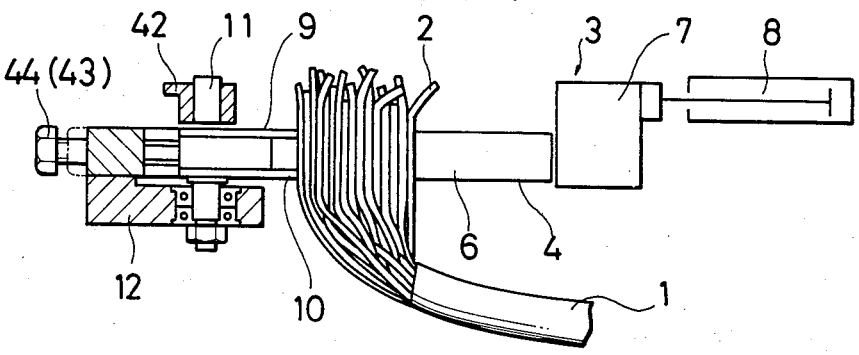

The apparatus shown in FIGS. 6 and 7 employs a rotor driving means 13, which is designed differently from the one used in the first embodiment and is capable of reciprocally rotating the conveying rotor 9.

The rotor driving means 13 shown in FIGS. 6 and 7 comprises an arm 41 having its one end fixed to the rotor shaft 11, and a cylinder 43 coupled to the other end of the arm 41 via a pin 42. The linear motion of the cylinder 43 is converted into a rotational motion by the arm 41, so that the rotor 9 to which the motion is transmitted is reciprocally rotated within a predetermined angle (90 degrees).

When the core holding groove 10 faces the guide slit 6, the conveying rotor 9 thus driven abuts against a first stopper 44 attached to the support 4 and stops rotating. When the core holding groove 10 faces the core extracting position 18, the conveying rotor 9 abuts against a second stopper 45 attached to the support 4 and also stops rotating.

Although the conveying rotor 9 shown in FIGS. 6 and 7 is not provided with the tubular groove 9A, it may be provided with such a groove. The tubular groove 9A prevents the knife-shaped electrode (detector 19) from deviating from its proper position due to a resistance of the core 2 in the core holding groove 10, when the electrode cuts in the insulative coating of the core.

Figure 8:
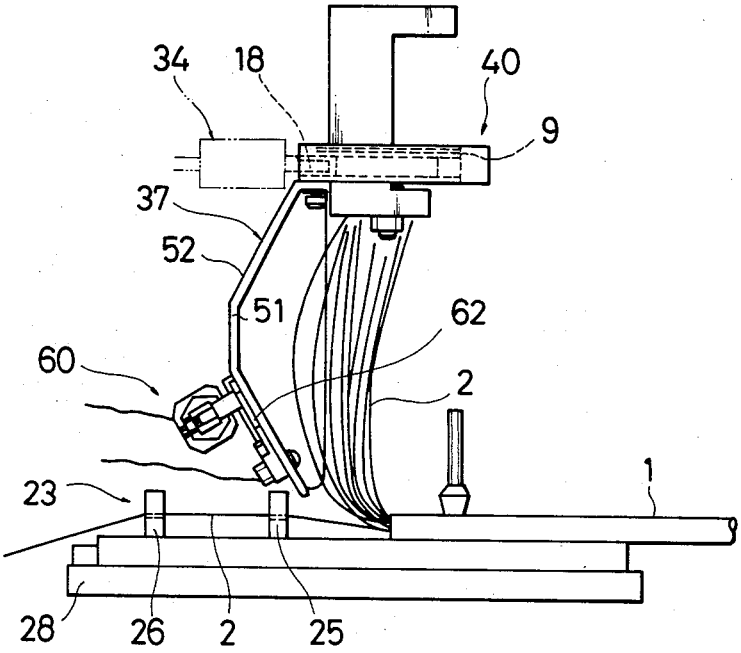
FIGS. 8 to 10 are front, side and plan views of a modification of core guiding means, respectively, of this invention and core-urging means.
Figure 9:
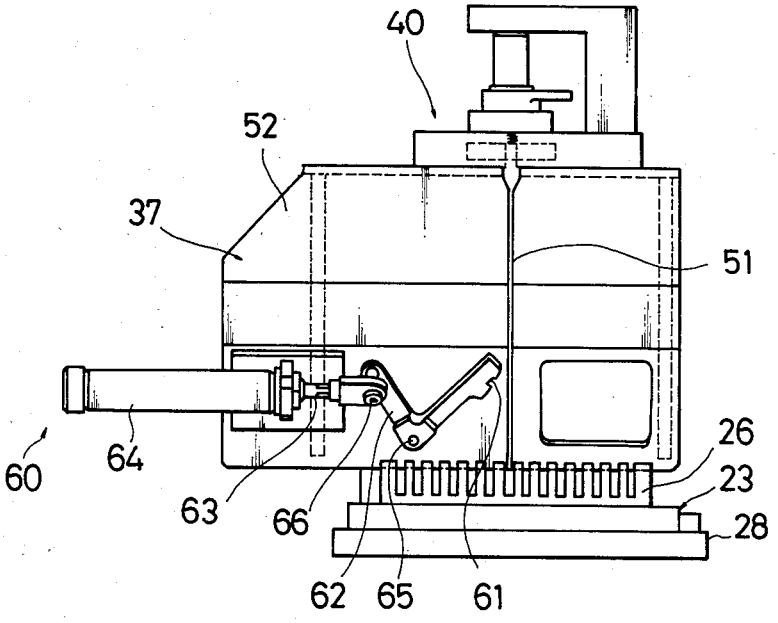
Figure 10:
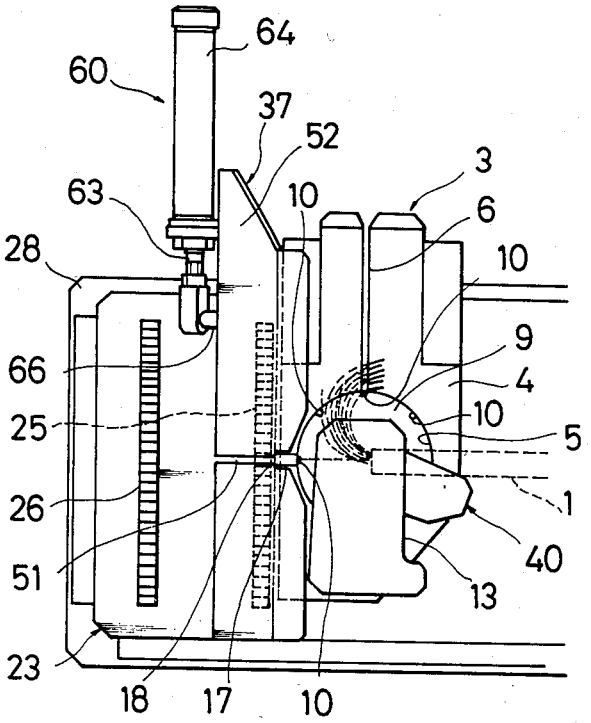

FIGS. 8 to 10 show a modification of the core guiding mechanism 37 and a core urging mechanism 60 additionally provided in the claimed apparatus.

The core guiding mechanism 37 shown in FIGS. 8–10 is constituted by a curved partition plate 52 having a core passing groove 61. The partition plate 52 separates a portion including the rotational conveyor 40 from the side including the core handling mechanism 33, in elevation.

The inner side wall (of a concaved shape) of the partition plate 52 faces the core feeder 3 and the rotational conveyor 40, and the core passing groove 51 of the partition plate 52 coincides with the core extracting position 18 and allows the core to be guided into the core positioning section 26 of the core holding member 26.

Because the partition plate 52 partitions the rotational conveyor side and the core handling mechanism side, each core 2 in a rising motion does not project toward the core handling mechanism 33 so that the core manipulating hand 34 grabbing a core 2 does not interfere with other cores.

Here, the core passing groove 51 guides only the core 2 held by the hand 34 directly to the core positioning section 26.

The core urging mechanism 60 in FIGS. 8–10 is provided at the partition plate 52. The core urging mechanism 60 comprises an L-shaped core urging arm 62, which has a concave-shaped core stopper 61 at its one end (distal end), and a cylinder 64 having a piston rod 63. The core urging arm 62 and the cylinder 64 are attached to the partition plate 62 and coupled to each other.

The core urging arm 62 is rotatably supported on the partition plate 52 via a shaft 65 provided at the bent section of the arm, while the cylinder 64 is attached to the partition plate by means of a known attaching member. The core urging arm 62 has its other end (proximal end) coupled to the distal end of the piston rod 63 by means of a jointing member 66.

The core urging mechanism 60 of FIGS. 8–10 urges the core 2 into the core positioning section 28 when the core manipulating hand 34 is setting the core it is holding into the respective core positioning section 26 of the core holding member 25.

More specifically, when the core manipulating hand 34 holding the core 2 descends to a predetermined height, the cylinder 64 which is operated by the signal of a sensor (not shown) that detects the height, urges the piston rod 63, which in turn rotates the distal end of the core urging arm 62. The core stopper 61 provided at the distal end of the core urging arm 62 catches the core 2. The core is therefore accurately urged into the core positioning section 26 of the core holding member 25 by the core urging arm 62, which descends with the core manipulating hand 34.

With the above arrangement, when the core 2 is sent into the core positioning section 26 of the core holding member 25, it is always possible to prevent the core from being guided to an unproper section or from being damaged en route to the core positioning section 26.

Figure 11:
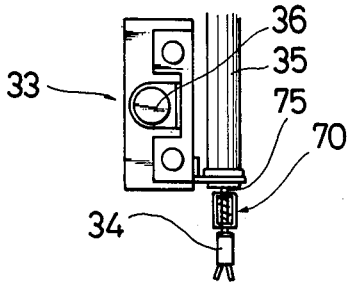
FIG. 11 is a front view of core handling means with a stretching unit of this invention.
Figure 12:
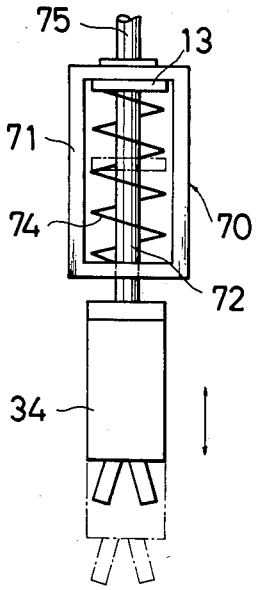
FIG. 12 is an enlarged front view of the stretching unit.

FIGS. 11 and 12 show a modification in which the core manipulating hand 34 of core handling mechanism 33 is supported by a stretching unit 70.

The stretching unit 70 is constituted such that the front portion of a frame 71 is penetrated by a slidable rod 72, which is provided at its rear end with a stopper 73, and a spring 74 extends from the front portion of the frame 71 to the stopper 73.

In the stretching unit 70, the frame 71 and the slidable rod 72 are stretchable with respect to each other, and the mutual compressing force is applied onto the frame 71 and the slidable rod 72 by the spring 74.

The rear portion of the frame 71 of the stretching unit 70 is coupled to a piston rod 75 of the cylinder 35, with the distal end of the slidable rod 72 being attached with the core manipulating hand 34. The stretching unit 70 is therefore located on the line connecting the core manipulating hand 34 and the piston rod 75 and is assembled in the core handling mechanism 33.

With the above arrangement, therefore, when the core 2 is manipulated using the core manipulating hand 34, the frame 71 of the stretching unit 70 and the slidable rod 72 stretch relative to each other, thus absorbing the tension on the core 2. This hardly causes the core to be damaged or cut by a significant amount of tension.

As explained above, the cable core self-aligning apparatus of this invention has its core feeder, a rotational conveyor with a conveying rotor, core identifying mechanism, core-holder positioning mechanism and core handling mechanism functioning in cooperation with one another with a higher efficiency. This cooperation ensures a smooth continuous operation such that the cores can be fed in line, are separated one at a time and sequentially conveyed to a core extracting position, and each core that has reached this position can be set into the proper core positioning section. In addition, before aligning of the preceding core is completed, aligning of the next core can be started. Consequently, about seven cores can be aligned per hour, thus reducing the overall aligning time. Also, since cores are separated from one another using a conveying rotor, it is unnecessary to use a sophisticated control unit.

What is claimed is:

1. A cable core self-aligning apparatus comprising:

core feeding means for holding a plurality of cores, drawn out of an end of a cable, in a line and sequentially feeding said cores;

rotational conveyor means having a conveying rotor for holding and rotationally conveying each of said cores, sequentially fed by said core feeding mechanism, to a core extracting position;

core identifying means for identifying the number of each core conveyed by said rotational conveyor means while that core is being conveyed to said core extracting position;

a core holder having a plurality of core-positioning sections;

core-holder positioning means for setting that of said core-positioning sections which is associated with the number of said core identified by said core identifying means, at said core extracting position when said core holder receives said identified core; and core handling means for holding and inserting said core reaching said core extracting position by the help of said conveying rotor, into said core-positioning section set by said core-holder positioning means.

2. The apparatus according to claim 1, wherein said conveying rotor has a core holding groove formed on a peripheral surface thereof in parallel to a rotational axis of said rotor.

3. The apparatus according to claim 1, wherein said conveying rotor has a core holding groove formed on a peripheral surface thereof in parallel to a rotational axis of said rotor, and has a tubular groove formed on said peripheral surface thereof, said tubular groove intersecting with said core holding groove.

4. The apparatus according to claim 1, wherein said conveying rotor is provided to intermittently rotate in one direction.

5. The apparatus according to claim 1, wherein said conveying rotor is provided to reciprocatively rotate said a predetermined angle.

6. The apparatus according to claim 1, wherein said core identifying means has detection means which is constituted by a knife-shaped electrode to provide an electrical connection between said core number identifying means and said cores.

7. The apparatus according to claim 1, wherein core guiding means having a core passing section is provided between said rotational conveyor means and said core-holder positioning means.

8. The apparatus according to claim 1, wherein core guiding means having a core passing section is provided to partition said rotational conveyor means and said core-holder positioning means.

9. The apparatus according to claim 1, wherein core urging means is provided between said rotational conveyor means and said core-holder positioning means to urge said cores into said core positioning sections of said core holder.

10. The apparatus according to claim 1, wherein said core handling means has a core manipulating hand supported by a stretching unit.

11. The apparatus according to claim 2 wherein said conveying rotor is provided to intermittently rotate in one direction.

12. The apparatus according to claim 3 wherein said conveying rotor is provided to intermittently rotate in one direction.

13. The apparatus according to claim 2 wherein said conveying rotor is provided to reciprocatively rotate within a predetermined angle.

14. The apparatus according to claim 3 wherein said conveying rotor is provided to reciprocatively rotate within a predetermined angle.

15. The apparatus according to claim 6 wherein core guiding means having a core passing section is provided to partition said rotational conveyor means and said core-holder positioning means.

* * * * *